United States Patent [19]

Beavan et al.

[11] 4,445,901

[45] May 1, 1984

[54] FABRIC CONDITIONING COMPOSITION

[75] Inventors: Stuart W. Beavan, Birkenhead; Edwin Willis, Wirral, both of England

[73] Assignee: Lever Brothers Company, New York, N.Y.

[21] Appl. No.: 426,506

[22] Filed: Sep. 29, 1982

[30] Foreign Application Priority Data

Oct. 9, 1981 [GB] United Kingdom ..... 8130556

[51] Int. Cl.[3] ..... D06L 3/04; D06M 13/46

[52] U.S. Cl. ..... 8/103; 8/102; 252/8.8

[58] Field of Search ..... 252/8.8, 102; 8/103

[56] References Cited

U.S. PATENT DOCUMENTS

| | | | |
|---|---|---|---|
| 3,173,749 | 3/1965 | Hintzmann et al. | 252/8.8 |
| 3,749,673 | 7/1973 | Jones et al. | 252/99 |
| 3,836,475 | 9/1974 | Kirner | 252/102 |
| 4,113,645 | 9/1978 | De Simone | 252/102 |
| 4,332,691 | 6/1982 | Beavan | 8/108 |

FOREIGN PATENT DOCUMENTS

| | | | |
|---|---|---|---|
| 18039 | 10/1980 | European Pat. Off. | 252/8.8 |
| 38099 | 10/1981 | European Pat. Off. . | |
| 38100 | 10/1981 | European Pat. Off. . | |
| 38590 | 10/1981 | European Pat. Off. . | |
| 926308 | 5/1963 | United Kingdom . | |
| 1053388 | 12/1966 | United Kingdom . | |
| 1073165 | 6/1967 | United Kingdom . | |
| 1397595 | 6/1975 | United Kingdom . | |
| 1475149 | 6/1977 | United Kingdom . | |
| 1536485 | 12/1978 | United Kingdom . | |
| 2022641 | 12/1979 | United Kingdom . | |

*Primary Examiner*—Maria Parrish Tungol

*Attorney, Agent, or Firm*—Milton L. Honig; James J. Farrell

[57] ABSTRACT

A fabric conditioning composition in solid or liquid form contains a fabric softening agent and a halite material such as sodium chlorite as a bleaching and/or germicidal agent. When in liquid form the composition may contain a stabilizing material to improve physical stability. In use, fabrics are contacted with a liquor containing the composition and the fabric and/or the liquor is irradiated with UV-light from an artificial source or from daylight.

5 Claims, No Drawings

FABRIC CONDITIONING COMPOSITION

This invention relates to a fabric conditioning composition. In particular, it relates to a fabric softening composition in solid or liquid form, which composition is capable not only of softening fabrics but also providing additional desirable benefits.

Fabric softening compositions, particularly in liquid form, are well known in the art and are commonly used in domestic laundering. Generally such products are aqueous dispersions containing from about 3% to about 7% by weight of a fabric softening agent, particularly cationic materials. These products are normally used in the last rinse of a washing process, whereby the fabric fibres take up some of the fabric softening agent resulting in a soft, fluffy feel of the fabric.

It is often desired to include in fabric softening compositions materials which provide the fabrics with additional benefits, particularly if it is not desired or not possible to include such materials in fabric washing compositions. Thus, it may be desirable to include in fabric-softening compositions germicides and/or bleaches.

Fabric washing compositions are known which contain photo-bleaches or bleaches activated by bleach activators. Thus, U.S. Pat. No. 4,033,718 describes a detergent composition containing particular species of zinc phthalocyanine as an oxygen bleach activator.

It is also known to use an alkali metal chlorite as a bleach. For example, it is known to bleach cellulose with sodium chlorite in an acid medium, the chlorite in the acid medium producing chlorine dioxide which is the species responsible for the bleaching. At higher pH, it is known to activate chlorites with activators such as hydroxylammonium salts (see U.S. Pat. No. 3,836,475) but such activators are expensive and may also be toxic. For these reasons they have not found commercial success in domestic situations.

It is also known that bleaching agents can act as germicides when used at concentrations lower than that necessary to obtain a perceivable bleaching effect.

It is an object of the present invention to provide a fabric conditioning composition which will provide a germicidal and/or bleaching effect at suitable domestic pH's without the high cost of activators.

We have now discovered that simultaneous softness and germicidal and/or bleach benefits can be achieved by using a conditioning composition containing a chlorite, or other halite, if the composition or the fabrics in contact therewith are exposed to ultraviolet light. The present invention provides a conditioning composition suitable for carrying out such a method.

Thus, according to the invention there is provided a fabric conditioning composition comprising a cationic fabric softening agent and optionally a liquid base, the composition yielding a pH of at least 6.0 when dispersed in from about 10 to about 800 parts by weight of water, characterised in that the composition further contains a material yielding halite ions in aqueous media, with the proviso that when a liquid base is present, the composition contains from 4% to 20% of said cationic fabric softening agent and from 0% to 25% by weight further electrolyte.

The compositions according to the invention preferably contain from about 0.1% to about 90% by weight of the halite material such as between about 5% and about 50% in the case of solid products, although lower levels may be preferred in liquid products. In a liquid form, it is thus desirable that the composition contains less than 40% of the halite material, such as from about 4% to about 20% by weight. This material is preferably selected from chlorites and bromites of substituted or unsubstituted ammonium, alkali metals such as sodium and potassium, or alkaline earth metals such as calcium or magnesium. The most preferred material is sodium chlorite.

The cationic fabric softening agent is preferably present at a concentration of at least 4% by weight of the composition. This material may be mixed with non-cationic fabric softening agents such as nonionic fabric softening materials, zwitterionic fabric softening materials, clays and mixtures thereof. In the case of solid products, the composition preferably contains no more than 90% of the cationic fabric softening agent.

The weight ratio of the fabric softening agent(s) to the halite material may be from about 2:1 to about 1:10, especially from about 1:1 to about 1:5.

Suitable examples of cationic fabric softening agents include:

(a) quaternary ammonium compounds such as dihardened tallow dimethyl ammonium chloride (Arquad 2HT), distearyl dimethyl ammonium chloride (Arosurf TA), disoya-alkyl dimethyl ammonium chloride (Arquad 2S), the corresponding dicoconut alkyl derivative (Arquad 2C);

(b) alkyl imidazolinium salts such as methyl (1) alkyl amidoethyl (2) alkyl imidazolinium methosulphate where the alkyl groups are tallow alkyl (Varisoft 475 and Ammonyx 4080);

(c) polyamines;

(d) alkylpyridinium salts; and (e) mixtures thereof.

Suitable examples of non-cationic fabric softening agents include:

(a) fatty esters such as sorbitan esters;

(b) ethers of fatty alcohols;

(c) smectite and other clays;

(d) calcium alkylphthalates; and (e) other non-cationic fabric softeners listed in the literature and any mixture of two or more of the foregoing.

In use, the fabric conditioning composition is diluted with water before contacting the fabrics. In the case of a solid fabric conditioning composition, the composition may be diluted with a relatively small quantity of water, which is then added to the bulk of the rinse liquor. Preferably the composition is dispersed in about 10 to about 800 parts of water. It is essential that in this dispersed state the composition has a pH of at least 6.0, preferably less than about 11.0. A particularly suitable pH range is between 6.0 and about 8.5.

The desired pH may be achieved by the addition of buffering agents, although were the various components of the composition have suitable natural pH, no buffering agent need be added:

The exposure to ultraviolet light may be achieved by exposing the dispersed composition or the fabrics in contact therewith to daylight or to an artificial source of ultraviolet light. Thus the dispersed composition may be irradiated before contact with the fabrics or while the dispersed composition is in contact with the fabrics, or alternatively the fabrics may be irradiated while in contact with the dispersed composition or thereafter. It is essential that this irradiation occurs before the halite is removed, eg by subsequent rinsing, from the fabrics.

It is possible for the composition to be dispersed in the last rinse of a fabric washing cycle, after which the fabrics are line-dried in daylight to provide the exposure to ultraviolet light. The ultraviolet light preferably has a component with a wavelength of between about 200 nm and about 400 nm, preferably less than 370 nm. The intensity of the ultraviolet light, as measured at the fabric surface or at the surface of the dispersed composition is preferably from about 0.01 to about 10.0, more preferably from about 0.05 to about 2.0 $Wm^{-2}$ $nm^{-1}$. Under these conditions a suitable exposure time is between about 10 minutes and about 10 hours, more preferably between about 30 minutes and about 4 hours, depending on the concentration of the chlorite in the dispersed composition and on the degree of bleaching required. The preferred light intensity can alternatively be expressed as from about $10^{-1}$ to about $10^{-6}$, preferably from about $10^{-2}$ to about $10^{-4}$ Einsteins of energy in the 200 nm to 370 nm wavelength region per liter of dispersed composition.

The fabric softening compositions of the invention may be in solid or liquid form. When in liquid form they will include a liquid base, which would generally consist primarily of water. As the exposure to ultraviolet light causes a breakdown of the chlorite ion in water, it is preferably that the liquid fabric conditioning composition is stored before use in a UV-opaque container.

It may be found that some liquid compositions according to the invention have an undesirably low physical stability. The stability of these products will depend on the nature of the fabric softening agent, the concentration thereof, the concentration of the halite material and the conditions under which the product is stored. In order to improve the physical stability of liquid products, they may contain one or more of the following stabilising materials:

(i) Non-aqueous solvents such as alkanols, in particular iso-propanol. When non-aqueous solvents are present, they are preferably present at a level which is less than the level of water in the composition.

(ii) A polymeric non-electrolyte such as polyethylene glycol. Such materials are described in British patent specification No. 2 053 249 (Case C.571).

(iii) A cyclic or non-cyclic hydrocarbon, in particular a hydrocarbon containing between 12 and 40 carbon atoms such as octadecane.

(iv) A fatty acid such as stearic acid or palmitic acid.

(v) A fatty acid ester of a monohydric alcohol such as iso-butyl stearate.

(vi) Salts and acids of the general formula

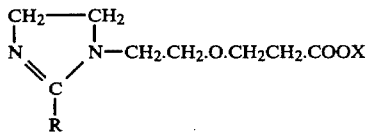

where X is hydrogen or an alkali metal and R is an alkyl group. These materials are available as Crodateric CY (caprylic-acid form), Crodateric CYNA (caprylic-sodium salt), Crodateric C(coconut-acid form), Crodateric S (stearic-acid form) and Crodateric O (oleic-acid form).

When a stabilising material is present, it is preferably present at a level of at least 0.5%, preferably at least 1% of the composition.

The compositions according to the invention may contain, in addition to the halite material, one or more further electrolytes. The amount of further electrolytes added must not be so much as to destroy the stable structure of the composition. In each case the maximum electrolyte level will depend on a number of factors including the nature of the electrolyte, the nature and quantity of the fabric softening agent, cosurfactant and other components which may be present in the compositions. Up to about 25% by weight, preferably not more than about 5% by weight of total further electrolyte may be included in the compositions of the invention.

Typical further electrolytes are the salts of monovalent and multivalent ions such as sodium chloride, sodium methosulphate, magnesium chloride, magnesium sulphate, lanthanum chloride, calcium chloride, aluminium chlorhydrate, sodium carbonate, sodium perborate and the like, and mixtures thereof.

The compositions of the invention may include other ingredients, particularly those included in conventional liquid fabric softening compositions such as rewetting agents, viscosity modifiers, perfumes, perfume carriers, fluorescers, colourants, hydrotropes, antifoaming agents, antiredeposition agents, enzymes, optical brightening agents, preservatives, dyes, other bleaches and bleach precursors, drape imparting agents and antistatic agents.

The composition before use should contain substantially no material which in the aqueous liquor will react with and remove the halite ions. Thus chlorite ions are known to react with chlorine or chlorine-producing materials such as calcium hypochlorite or sodium dichloroisocyanurate to produce chlorine dioxide. Thus the composition preferably contains for each part by weight of halite yielding material, less than 0.4 parts, advantageously less than 0.1 parts by weight of a material which in aqueous media in the absence of UV-light reacts to a substantial extent with the halite ions, that is reacts with at least a major proportion of the halite ions.

The compositions according to the invention may be made by a variety of methods. Where the product is in the form of a liquid, a preferred method is to melt the softener and the stabilising material, if any, together and disperse this mixture in water while maintaining an elevated temperature. The chlorite is then added and the composition is allowed to cool.

A suitable machine for carrying out the present invention comprises a vessel adapted to hold the liquor and the fabrics, and at least one light source adapted to irradiate at least part of the liquor and/or the fabrics in contact with the liquor, the or each said light source emitting light of wavelength less than 400 nm.

The machine may comprise means for maintaining the liquor temperature at a desired value, such as heating means.

Optionally the or each said light source is mounted on a wall portion of the vessel or on a closure lid or door therefor. Alternatively or additionally, the or each said source is mounted adjacent a chamber through which the liquor is circulated, enabling the liquor to be irradiated prior to its contact with the fabrics. Such a chamber should include at least one wall which is transparent to ultra-violet light, preferably down to 300 nm, although it is possible for this wall to be opaque to visible light. A suitable material for the transparent wall is pyrex.

The machine may have the features of any suitable type of domestic or commercial fabric washing machine, for example, a fixed tub in which the contents of the tub are agitated by a paddle or a pulsator cylinder containing the articles to be washed which revolves within a fixed cylinder which holds the wash liquor.

The activation of the light(s) can be controlled by (an) appropriate device(s) according to the wash problem. For example, when white cotton loads are being washed, the light(s) will normally be activated at some stage of the process. When washing, for example, wool, illumination and therefore bleaching will usually be excluded.

The timing and degree of illumination may be predetermined by the programming device or may be controlled by appropriate sensors for parameters such as temperature, optical density and/or pH.

The ultra-violet light source may, for example, be of the quartz-iodine, xenon or mercury discharge types. A 400 W mercury-iodine lamp would be particularly suitable, positioned so that the light would be incident in use on the glass/liquor interface.

The invention will now be illustrated by the following non-limiting Examples in which percentages and parts are by weight unless otherwise specified.

EXAMPLE 1

A pyrex cell was partially filled with a treatment liquid, made up as specified below. Heavily tea stained clothes were immersed in the treatment liquod. The cell was then placed in the chamber of an ATLAS WEATHEROMETER which had been adjusted to an output to similate solar radiation both in intensity and energy distribution. The chamber had an initial temperature of about 22° C. After irradiating the cloths from one side only for a selected time the % reflectance at 460 nm was measured using a Zeiss "Elrepho" reflectometer fitted with a UV-filter and the reflectance change, ΔR460* was determined by comparing the measured reflectance of the treated cloth with that of the same cloth before treatment. The treated cloths were monitored, both those regions of the cloths which were immersed in the treatment liquid and those regions of the cloths which were suspended above the treatment liquid and which were contacted with the treatment liquid only as a result of capillary action from the immersed regions. Reflectance changes of both front and back of each cloth were measured.

The totally immersed cloth simulates a method of conditioning fabrics in a washing machine which incorporates a source emitting UV-light or in a bowl in daylight, whereas the suspended cloth simulates a re-wet sun-bleaching operation.

Two treatment liquids were tested. The first, liquid (A) constituting a control, was made up by dispersing a composition containing 6.5% Arquad 2HT in water to give a treatment liquid containing 0.13 g/l of the fabric softener. The second, liquid (B), was made up by dispersing a composition containing 1 part by weight of Arquad 2HT and about 3.8 parts by weight of sodium chlorite in water to give a treatment liquid containing 0.13 g/l of the fabric softener and 0.5 g/l of sodium chlorite. This second liquid had a pH between 8.5 and 11.0. The results are shown in the following Table I.

TABLE I

| Test Liquid | Irradiation time (hrs) | Δ R460* Suspended cloth Front | Suspended cloth Back | Immersed cloth Front | Immersed cloth Back |
|---|---|---|---|---|---|
| A | 0 | 0.2 | 0.2 | 0.2 | 0.2 |
| A | 2 | 1.5 | 0.9 | 0.3 | 0.5 |
| B | 0 | −0.2 | −0.2 | −0.2 | −0.2 |
| B | 2 | 1.6 | 1.2 | 11.1 | 10.0 |

EXAMPLE 2

The following solid compositions were prepared and were found to give a positive bleaching benefit when utilised at a concentration sufficient that the treatment liquor contained about 0.5% chlorite. The compositions were prepared by dry mixing in a coffee mill technical grade sodium chlorite and a solid rinse product formed in accordance with British Pat. No. 1 597 513. Details of the compositions are set out in the following Table II.

TABLE II

| Example | 2A | 2B |
|---|---|---|
| Sodium chlorite | 35% | 50% |
| Arquad 2HT | 13% | 10% |
| Urea | 39% | 30% |
| Glyceryl trioleate | 6.5% | 5% |
| Ethoxylated soya amine | 6.5% | 5% |

EXAMPLE 3

In this Example, the method of Example 1 was followed except that one set of cloths were soaked in the test liquor and then line dried with rewetting every ½ hour with distilled water. A second set of cloths was totally immersed in the test liquor. The totally immersed cloth simulates a method of conditioning fabrics in a washing machine which incorporates a source emitting UV-light or in a bowl in daylight, whereas the line dried cloth simulates a rewet sunbleach operation.

Six formulations according to the invention were prepared, each formulation containing, as the cationic material, Ammonyx 4080 in the form of a vacuum dried material of 94% activity, as the stabilising material, Crodateric CYNA 50 in the form of a 45% active dispersion and technical grade sodium chlorite of approximately 70% activity. The balance of each composition was made up by demineralised water.

Each composition was prepared by melting the cationic and the stabilising material and dispersing this molten mix in a small quantity of water. The rest of the water was added slowly with stirring on a hot plate, maintaining a with continuous heating and stirring. Details of the compositions are given in the following Table III together with the test results obtained. The values of ΔR460* quoted are the average of the measurements taken on the back and front of the cloths after 2 hours.

TABLE III

| Example No | Cationic % | Stabilising Material % | Chlorite % | Δ R460* (2 hrs) Line dried | Δ R460* (2 hrs) Solution |
|---|---|---|---|---|---|
| 3A | 6.0 | 3.0 | 5.0 | 2.4 | 2.5 |
| 3B | 6.0 | 4.0 | 5.0 | 1.5 | 1.4 |
| 3C | 6.0 | 5.0 | 5.0 | 1.0 | 1.1 |
| 3D | 6.0 | 6.0 | 5.0 | 1.6 | 1.9 |
| 3E | 6.0 | 4.0 | 10.0 | 2.3 | 6.6 |
| 3F | 6.0 | 4.0 | 15.0 | 2.3 | 12.7 |

Each treatment liquor contained 3.3 g/l of the test composition. The pH of the treatment liquor in Example 3B was 7.75. In other Examples the pH was similar.

These results demonstrate that a positive bleach benefit is obtained after 2 hours irradiation with all the test compositions.

We claim:

1. A fabric conditioning composition consisting essentially of:

(i) a cationic fabric softening agent;

(ii) a material yielding halite ions in aqueous media; and (iii) optionally a liquid base, when said liquid base is present, the composition contains from 4% to 20% of said cationic fabric softening agent and from 0% to 25% by weight of an electrolyte;

the composition yielding a pH of at least 6.0 when dispersed in from about 10 to about 800 parts by weight of water.

2. A fabric conditioning composition according to claim 1, wherein the material yielding halite ions in aqueous media constitutes from about 0.1% to about 40% by weight of the composition.

3. A fabric conditioning composition according to claim 1, further containing stabilising material selected from non-aqueous solvents, polymeric non-electrolytes, cyclic or non-cyclic hydrocarbons, fatty acids, fatty acid esters and salts and acids of the general formula

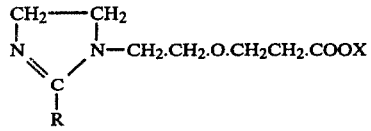

wherein X is hydrogen or an alkali metal and R is an alkyl or alkenyl group having from 7 to 17 carbon atoms.

4. A fabric conditioning composition according to claim 3 containing at least about 0.5% by weight of said material yielding halite ions and at least about 0.5% by weight of said stabilising material.

5. A method of conditioning fabrics comprising contacting the fabrics with a composition according to any one of claims 2 to 4 or in an aqueous medium and exposing said composition to ultraviolet light prior to or simultaneously with the contact with the fabrics, or exposing said fabrics to ultraviolet light subsequent to the contact with said composition.

* * * * *

UNITED STATES PATENT AND TRADEMARK OFFICE

CERTIFICATE OF CORRECTION

PATENT NO. : 4,445,901

DATED : May 1, 1984

INVENTOR(S) : Beavan et al.

It is certified that error appears in the above—identified patent and that said Letters Patent is hereby corrected as shown below:

At column 6, Example 3, line 52, after the words "maintaining a" add -- temperature of at least 50°C. The chlorite was then added --.

Signed and Sealed this

Third Day of June 1986

[SEAL]

*Attest:*

DONALD J. QUIGG

*Attesting Officer*

*Commissioner of Patents and Trademarks*